US008870686B1

(12) United States Patent
Johnson

(10) Patent No.: US 8,870,686 B1
(45) Date of Patent: Oct. 28, 2014

(54) GOLF TEE INSTALLATION DEVICE

(71) Applicant: Jerome G. Johnson, Willman, MN (US)

(72) Inventor: Jerome G. Johnson, Willman, MN (US)

( * ) Notice: Subject to any disclaimer, the term of this patent is extended or adjusted under 35 U.S.C. 154(b) by 0 days.

(21) Appl. No.: 13/892,835

(22) Filed: May 13, 2013

(51) Int. Cl.
*A63B 57/00* (2006.01)

(52) U.S. Cl.
CPC ..... *A63B 57/0037* (2013.01)
USPC ..... 473/386

(58) Field of Classification Search
USPC ..... 473/386, 132, 137; 294/19.2, 19.3
See application file for complete search history.

(56) References Cited

U.S. PATENT DOCUMENTS

| | | | | |
|---|---|---|---|---|
| 1,863,140 | A * | 6/1932 | Mulvaney | 473/133 |
| 3,904,200 | A * | 9/1975 | Jackle et al. | 473/133 |
| 4,266,748 | A * | 5/1981 | Dalton | 248/425 |
| 4,949,961 | A * | 8/1990 | Milano | 473/133 |
| 5,080,357 | A | 1/1992 | Wolf | |
| 5,335,953 | A | 8/1994 | Luther, Sr. | |
| 5,505,510 | A | 4/1996 | Duncan | |
| 5,624,333 | A * | 4/1997 | Dayton | 473/386 |
| 6,053,821 | A * | 4/2000 | Palmer | 473/386 |
| 6,203,452 | B1 * | 3/2001 | Kelman et al. | 473/386 |
| 6,739,477 | B1 | 5/2004 | Pascual | |
| 7,165,796 | B1 | 1/2007 | Hung | |
| 7,175,547 | B2 * | 2/2007 | Naus, Jr. | 473/386 |
| 7,384,347 | B2 | 6/2008 | Milne | |
| 7,713,136 | B1 | 5/2010 | Colucci | |
| D656,569 | S * | 3/2012 | Cisneros | D21/720 |
| 8,191,945 | B2 | 6/2012 | Compton | |
| 8,201,864 | B2 | 6/2012 | Wright | |
| 2003/0101634 | A1 * | 6/2003 | Bhullar | 43/1 |
| 2003/0222467 | A1 | 12/2003 | Khubani et al. | |
| 2004/0029653 | A1 * | 2/2004 | Whitehill et al. | 473/386 |
| 2008/0185855 | A1 | 8/2008 | Compton | |

* cited by examiner

*Primary Examiner* — Steven Wong
(74) *Attorney, Agent, or Firm* — Robert C. Montgomery; Montgomery Patent & Design

(57) ABSTRACT

A golf tee placement apparatus for inserting golf tees and setting up of golf balls from a standing position. The apparatus comprises a tube with an upper end having a hand grip assembly for holding and operating the apparatus. The tube allows loading and moving a golf tee and golf ball downward to a ball holder assembly which retains the golf ball in place above the golf tee. The handle assembly includes a trigger release mechanism which opens and closes the ball holder assembly to release the golf ball and golf tee, leaving a set up golf ball on a golf tee behind.

17 Claims, 12 Drawing Sheets

GOLF TEE INSTALLATION DEVICE

RELATED APPLICATIONS

There are no current co-pending applications.

FIELD OF THE INVENTION

The presently disclosed subject matter is generally directed golf aids. More particularly, the present invention relates to a manually-operated golf ball and tee placement device that does not require a user to bend over.

BACKGROUND OF THE INVENTION

Golf is a very popular game based on precision ball control using a club. The game is played both professionally and by millions of amateurs, young and old, skilled and less skilled, alike. Golf is usually played by golfers that compete in attempts to use different golf clubs to strike golf balls into a series of holes on a golf course. The winner is usually the golfer who accomplishes that task in the fewest number of strokes.

Golf is endlessly fascinating to young and old, men and women, and skilled and those not so skilled. The game challenges perfection, something that is seemingly just out of reach no matter how good a player become. A lifetime can be spent attempting and failing to achieve a perfection that always remains a possibility.

Over the years golf has attained the status of a leading leisure time outdoor sporting activity. Playing golf provides the satisfaction of being out in the fresh air, benefiting from enjoyable exercises of hitting a golf ball and then traversing over a beautifully manicured course while playing a competitive game.

However, before a single golf swing can be taken a golf ball first must be set upon a golf tee. To do this a golfer bends over to insert the golf tee into the ground and then the golf ball is placed on the golf tee. This task is highly repetitive and quickly becomes tiring even for those who are in good shape. Practicing on a driving range makes that activity highly repetitive. For the elderly, disabled, overweight, or otherwise informed the act of placing a golf ball on a golf tee is not practical or sometimes even possible. In addition, for the elderly or otherwise informed the acts of locating a golf tee, placing a golf ball on it, and then picking up the golf tee may consume an excessive amount of time. The aforementioned act of bending over must be repeated when picking up the golf balls and the golf tees.

In view of the foregoing problems of bending over there exists a need for a device by which golf tees and golf balls can be easily set and retrieved without the necessity of bending over. Beneficially such a device would assist the placement of the golf tees and golf balls at the desired locations while also saving time. Such a device would be particularly helpful to the handicapped, disabled, elderly, or otherwise informed. Preferably such a device could be easily stored in standard golf bags along with golf clubs. Ideally, such a device would allow simple, natural positioning of golf balls and golf tees as well as their retrieval.

SUMMARY OF THE INVENTION

The principles of the present invention provide for an apparatus that can set up golf balls on golf tees and then retrieve the golf balls and golf tees without bending over. The apparatus can assist placement of golf tees and golf balls at desired locations while saving time. The apparatus is particularly helpful to the handicapped, disabled, elderly, or otherwise informed. Beneficially the apparatus can be easily stored in standard golf bags along with golf clubs while enabling simple, natural positioning of golf balls and golf tees.

A golf placement apparatus in accord with the present invention includes a tube assembly having a tube assembly body, a handle assembly for passing received golf balls and tees to the tube assembly, with the handle assembly having a trigger release mechanism, and a golf ball teeing assembly for receiving golf balls and tees from the tube assembly. The golf ball teeing assembly places a golf ball on a tee, inserts an end of the tee into the ground, and releases the golf ball and tee in response to activation of the trigger release mechanism.

Beneficially the golf placement apparatus includes a hook attached to the handle assembly for attaching the golf placement apparatus to an external receiver such as a golf bag. The golf placement apparatus preferably includes a plurality of adjustable deployable legs that limit how far a tee can be inserted. In practice, a depth adjustment may control the adjustment of the legs. Such a depth adjustment might include a pinion gear, a housing over the tube assembly body and which is operatively connected to the pinion gear such that the position of the housing depends on the rotation of the pinion gear. The depth adjustment may further include a leg actuator ring that contacts at least one (1) of the legs. In practice, the rotation of the pinion gear may move the housing down the tube assembly body which may then allow the leg actuator to be adjusted to change the angle the leg makes with the tube assembly body. Full adjustment of the depth adjustment housing may force the leg into a collapsed and stowed position.

Beneficially the golf placement apparatus includes a golf ball teeing assembly having a ball holder assembly for receiving the tee and golf ball and for holding the tee and golf ball in position as the tee is inserted into the ground. Preferably, the ball holder assembly will include a ball holder opening which enables the tee to protrude out as the golf ball rests on the tee, while a ball keeper rod selectively prevents a golf ball on a tee from moving upward as the tee is inserted.

In practice the ball holder assembly might include a multiple piece ball holder that is supported by ball holder rods and that forms a cup for holding a golf ball. The ball holder rods may operatively connect to the trigger release mechanism such that operation of the trigger release mechanism causes the ball holder rods to spread open the ball holder to release the golf ball. If so, the ball holder rods may be lifted via the trigger release mechanism to cause the ball holder to contact an annular member that forces the ball holder away from the golf ball. To that end the ball holder rods may be formed from an inverted "U"-shaped element that is mechanical connected to the trigger release mechanism by a ball release linkage that simultaneously raises the ball holder rods when the trigger release mechanism is squeezed. The ball holder rods may pass through holder rod slots through the tube assembly body.

Additionally, the golf placement apparatus may include a rod pin for moving the ball keeper rod away from a golf ball when the rod pin is moved by a ball keeper trigger that passes through the tube assembly. Preferably the handle assembly has a circular cross-section, is permanently affixed to the tube assembly, and has a hand grip. Additionally, each leg may include a pivoting foot.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
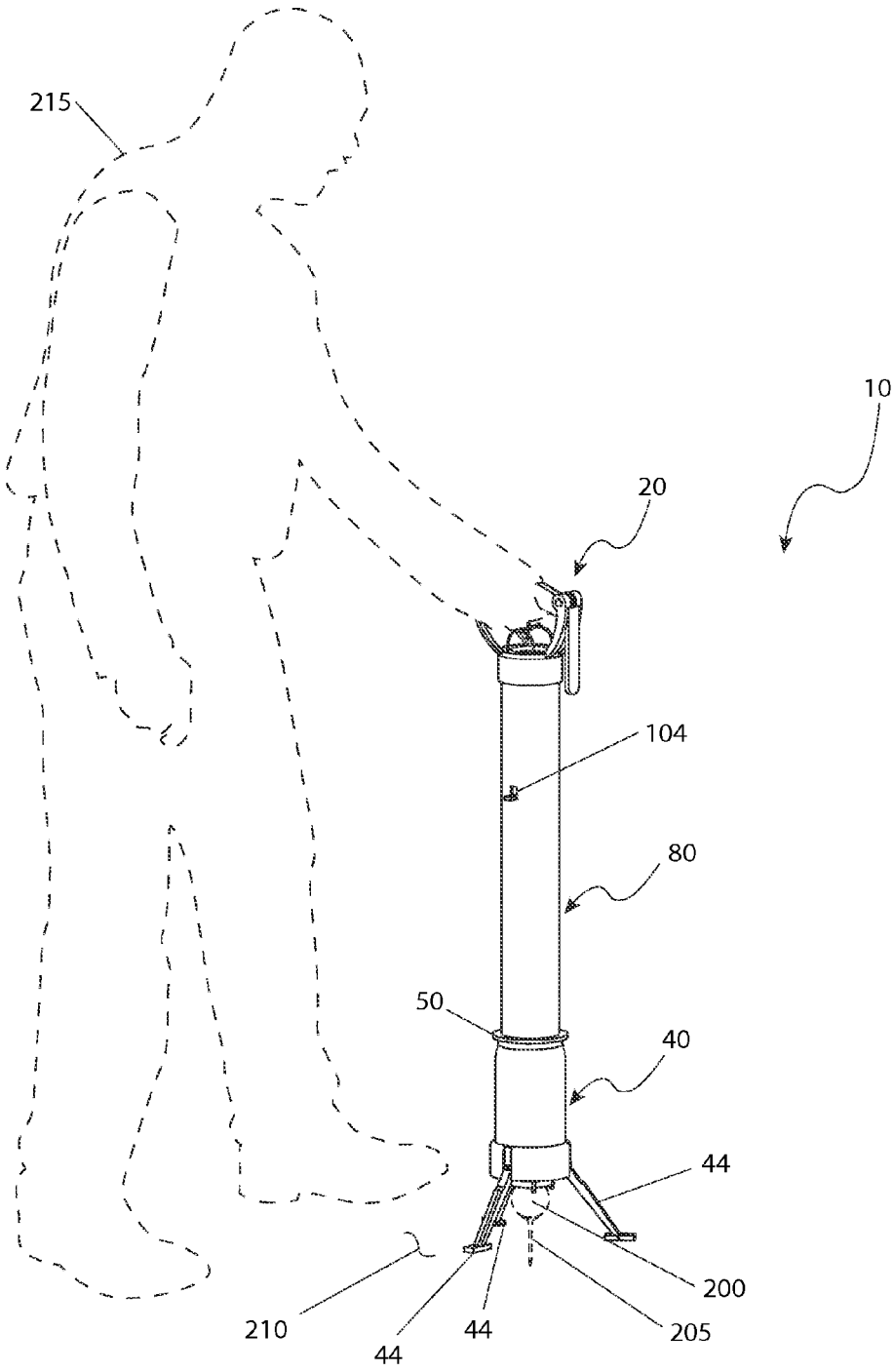
FIG. 1 is an environmental view of an in use golf placement apparatus 10 according to a preferred embodiment of the present invention.

10 golf placement apparatus
20 handle assembly
22 hook feature
24 grip
26 grip bracket
28 trigger release mechanism
29 trigger pivot pin
30 ball release linkage
40 golf ball teeing assembly
44 leg
45 leg pinion gear
46 foot
47 foot pin
48 leg pinion axle
49 depth adjustment housing
50 leg actuator ring
52 actuator sleeve
54 depth adjustment pinion gear
55 adjustment pinion aperture
56 adjustment pinion axle
57 leg slot
58 actuator post
59 actuator rack gear
60 ball holder assembly
61 ball holder rod
62 ball holder quadrant
63 ball holder pin
64 pin aperture feature
66 ball holder opening
70 adjustment pinion axle socket
72 leg pinion axle socket
80 tube assembly
82 tube body
83 golf ball aperture
84 holder rod aperture
85 holder rod slot
86 tube cam feature
87 keeper rod aperture
88 depth adjustment rack gear
90 ball keeper rod
92 rod pivot
94 rod pin
100 trigger rod
102 keeper rod slot
104 ball keeper trigger
105 trigger aperture
200 golf ball
205 tee
210 ground surface
215 golfer
220 golf bag

DETAILED DESCRIPTION OF THE PREFERRED EMBODIMENT

The best mode for carrying out the invention is presented in terms of its preferred embodiment, herein depicted within FIGS. 1 through 8*b*. However, the invention is not limited to the described embodiment, and a person skilled in the art will appreciate that many other embodiments of the invention such as a motorized version are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
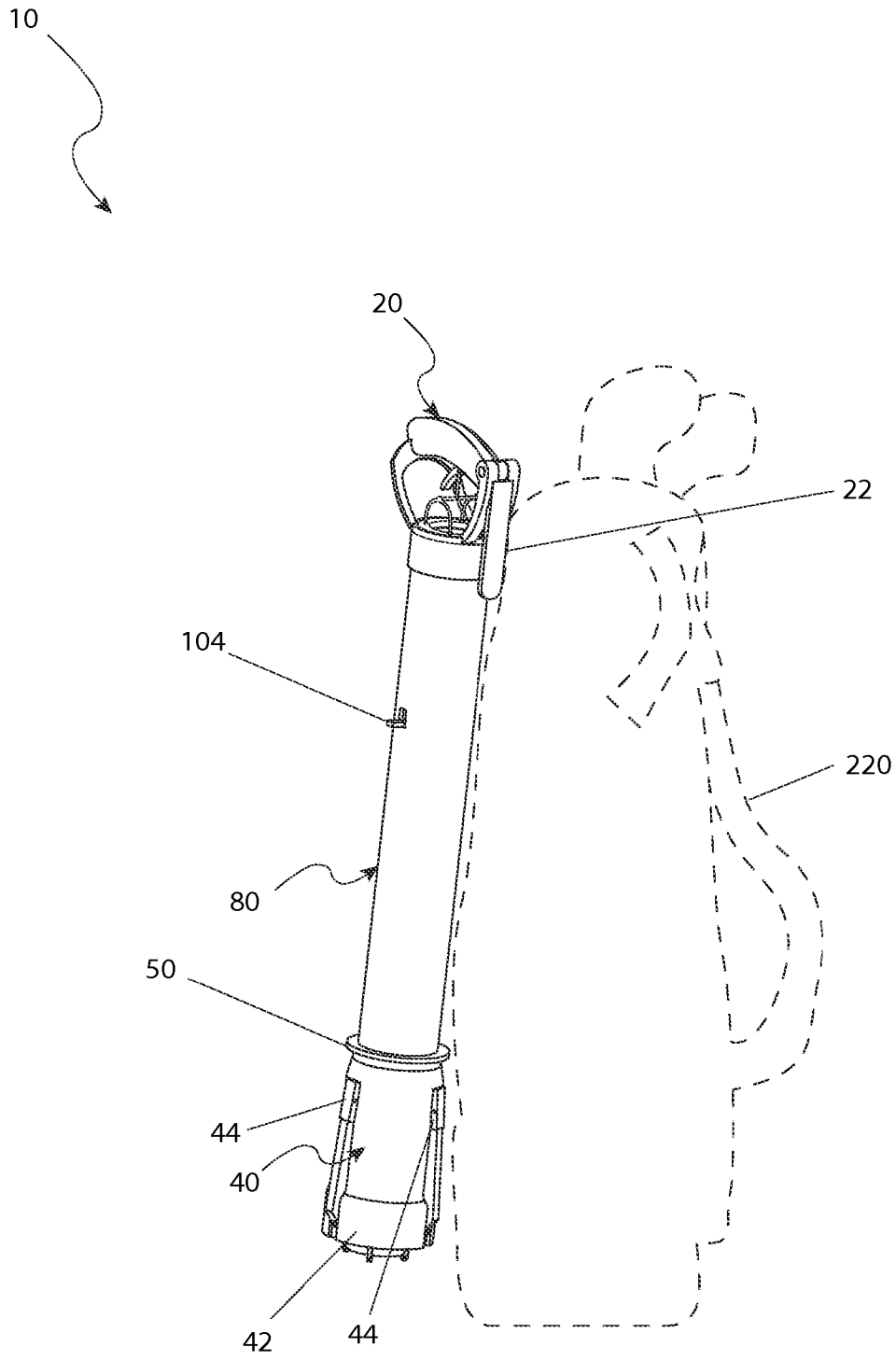
FIG. 2 is another environmental view of the golf placement apparatus 10 shown in FIG. 1 when stowed on a golf bag 220.
Figure 3A:
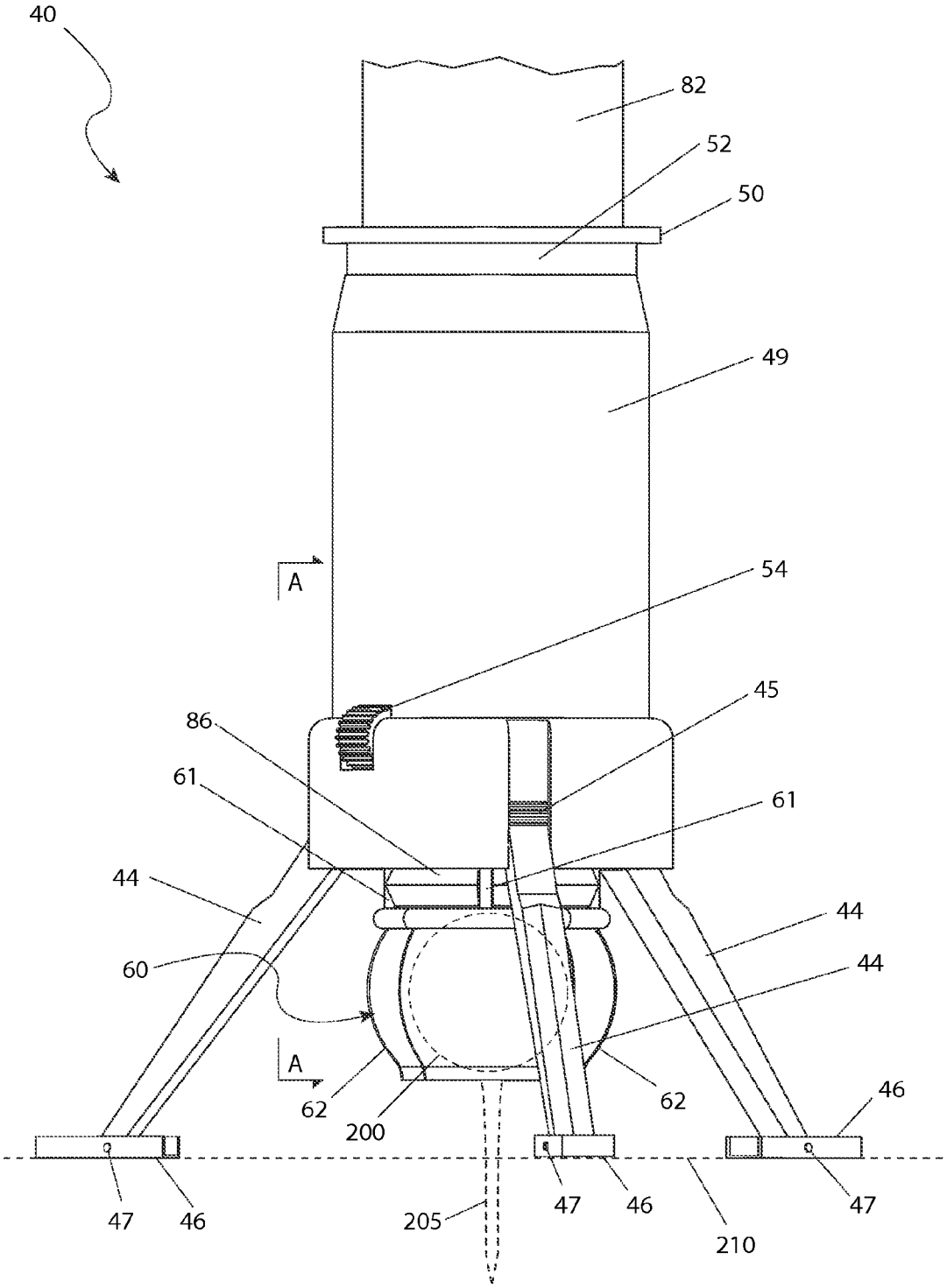
FIG. 3*a* is a close-up view of a golf ball teeing assembly 40 used in the golf placement apparatus 10 shown in FIG. 1 while setting up a golf ball 200 on golf tee 205.
Figure 3B:
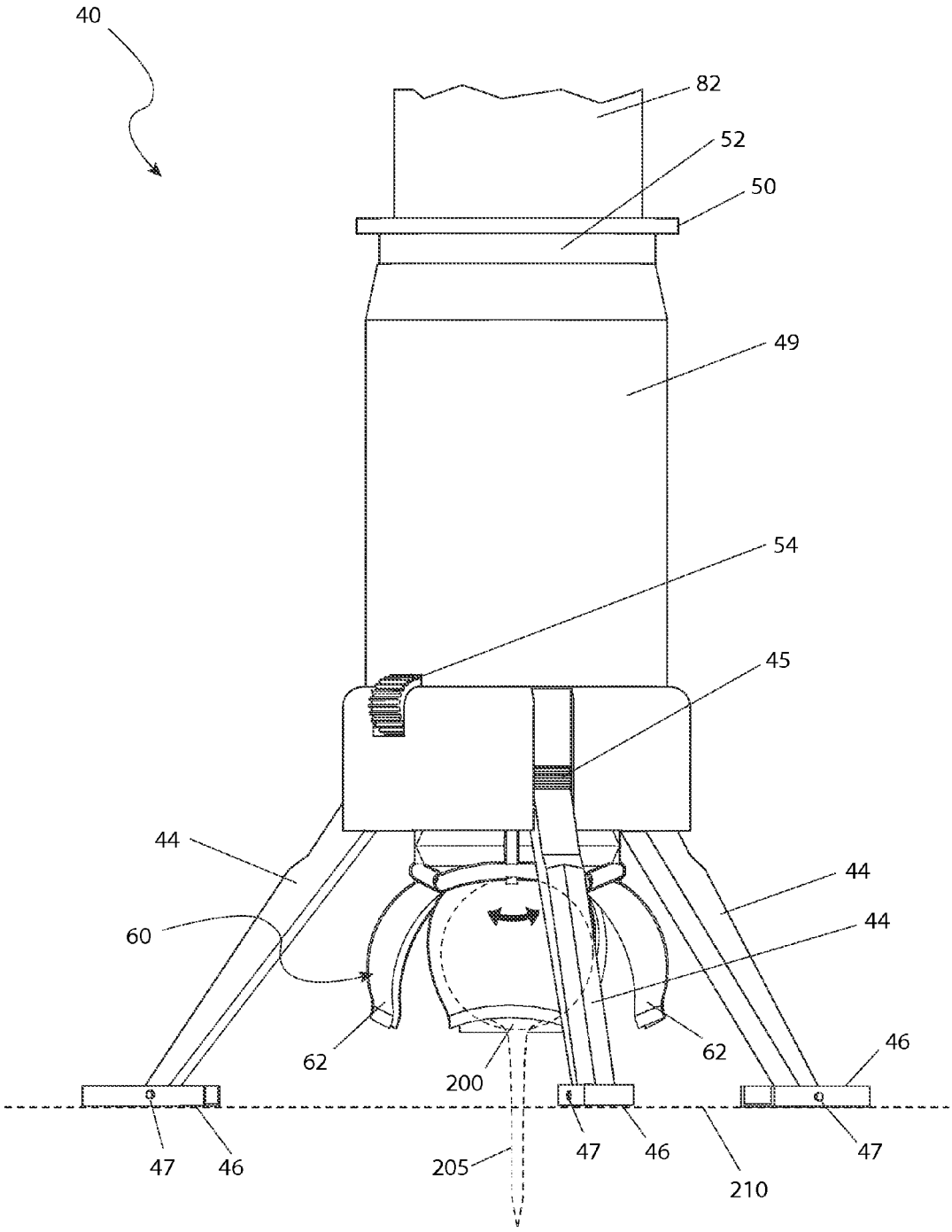
FIG. 3*b* is another close-up view of the golf ball teeing assembly 40 shown in FIG. 3*a* when releasing the golf ball 200 and golf tee 205.
Figure 3E:
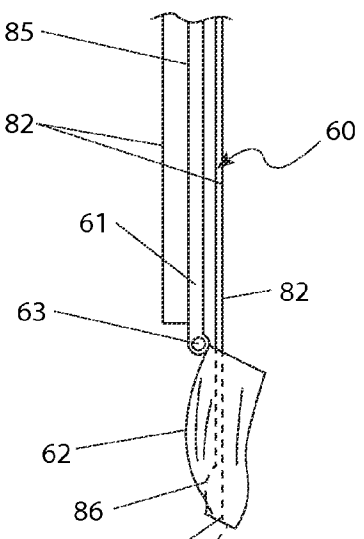
FIG. 3*e* is yet another isolated section view taken along section line A-A of FIG. 3*a* and showing a fully retracted ball holder assembly.
Figure 3F:
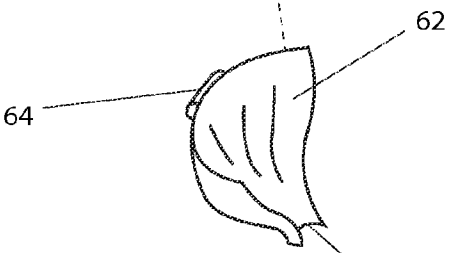
FIG. 3*f* is a close-up view of a ball holder quadrant 62 of the ball holder assembly 60 shown in FIGS. 3*c*-3*e;*
Figure 3D:
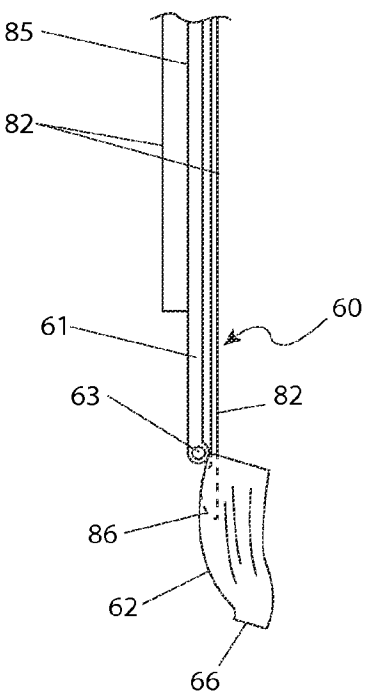
FIG. 3*d* is another isolated section view taken along section line A-A of FIG. 3*a* and showing the ball holder assembly 60 partially deployed.
Figure 3C:
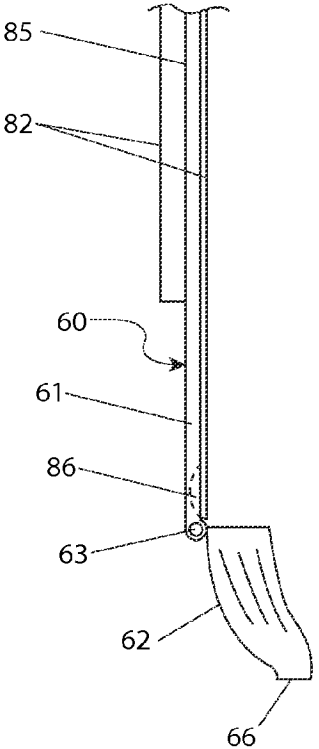
FIG. 3*c* is an isolated section view taken along section line A-A of FIG. 3*a* and showing a fully deployed ball holder assembly 60.

FIGS. 1 and 2 respectively present environmental views of a golf placement apparatus 10 in an in-use state and in a stowed state. The golf placement apparatus 10 enables a golfer 215 to insert a golf tee 205 that supports a golf ball 200 into the ground 210 without the golfer 215 having to bend over. The golf placement apparatus 10 includes a handle assembly 20 that is permanently affixed to a hollow tube assembly 80, which in turn is affixed to a bottom-mounted golf ball teeing assembly 40. The handle assembly 20 enables top-loading and delivery of golf tees 205 and golf balls 200 through the hollow tube assembly 80 to the bottom-mounted golf ball teeing assembly 40. The golf placement apparatus 10 is envisioned to be made using injection molded plastic where possible, and corrosion-resistant metal or a metal with corrosion inhibiting paint where appropriate, depending on strength and durability requirements. Other possible materials include composites, epoxies, fiberglass, resins, aramids, and carbon graphite in order to provide a durable, resilient, and lightweight construction.

The tube assembly 80 is designed to contain a plurality of balls 200 allowing the apparatus 10 to perform various methods of use such as dispensing a plurality of balls 200 without tees 205 in a sequential manner, or collecting a number of golf balls 200 from a ground surface 210 without bending over (see "method of utilizing the apparatus 10" section below). During another method of use, a user 215 loads a golf tee 205, then a golf ball 200 into the tube assembly 80. While holding the golf placement apparatus 10 by the handle assembly 20 the golfer 215 inserts the golf tee 205 and golf ball 200 into the ground 210 at a desired location. The handle assembly 20 includes a trigger release mechanism 28 which releases the golf ball 200 and golf tee 205, leaving them behind ready for a golf swing (also see FIG. 4*a*).

The described actions occur while the golfer 215 is standing. This allows the golfer 215 to easily place golf balls 200 and golf tees 205 without bending over. Consequently the golf placement apparatus 10 is especially useful to golfers who are elderly, physically disabled, or otherwise unable to or have difficulty bending over. Additionally, the golf placement apparatus 10 may be used to pick up golf balls 200 and tees 205 while standing in a manner that is described subsequently.

Referring now to FIGS. 1-3*b*, 4, 6*a*,-6*b*, and 7 the golf ball teeing assembly 40 includes three (3) deployable legs 44. Those legs 44 can be used to position the golf placement apparatus 10 in a "free-standing" manner. In addition, the three deployable legs 44 limit how far a golf tee 205 is pushed into the ground. Referring now primarily to FIGS. 2 and 4, the golf placement apparatus 10 also includes an inverted "U"-shaped hook 22 along one (1) side of the handle assembly 20. The hook 22 enables easy attachment and stowage of the golf placement apparatus 10 on an existing golf bag 220 or other suitable receiver.

FIGS. 3*a*-3*f* present various views of the golf ball teeing assembly 40 and a ball holder assembly 60 that are used in the golf placement apparatus 10. The golf ball teeing assembly 40 provides a means to receive, position, insert, and release a golf tee 205 and a golf ball 200 while the golfer 215 stands. The golf ball teeing assembly 40 includes the three (3) collapsible legs 44, a depth adjustment housing 49, the ball holder assembly 60, and a ball keeper rod 90 (best shown in FIGS. 5*a* and 5*b*).

The legs 44 are linear members having pivoting feet 46. The legs 44 are positioned at a selectable height as determined by the adjustment of a depth adjustment pinion gear 54 (described in more detail subsequently, and see FIG. 7) which is located on the depth adjustment housing 49.

Referring now to FIGS. 4*a*-5*b*, the golf tee 205 and golf ball 200 are loaded into a golf ball aperture 83 in the handle assembly 20. The golf tee 205 and golf ball 200 free-fall down into the tube body 82 of the tube assembly 80. The golf tee 205 and the golf ball 200 are received and held in position within the ball holder assembly 60. The ball holder assembly 60 includes a bottom ball holder opening 66 (reference FIGS. 3*c*-3*f*) which allows the shaft of the golf tee 205 to protrude as the golf ball 200 rests on the golf tee 205.

Referring now to FIGS. 3*a*-4*a*, the ball holder assembly 60 includes four (4) ball holder quadrants 62 which are supported by respective ball holder rods 61. When in a "relaxed" state the ball holder quadrants 62 form a hemispherical "cup-shaped" vessel into which the golf ball 200 snuggly rests. Once the golf tee 205 is inserted into the ground 210, the golfer 215 actuates the trigger release mechanism 28 (see FIG. 4*a*). This raises the aforementioned ball holder rods 61 and spreads the ball holder quadrants 62 outward to release the golf ball 200 onto the golf tee 205.

The ball holder rods 61 are fixed in a non-rotating manner to respective ball holder quadrants 62 by ball holder pins 63 and pin apertures 64 (see FIGS. 3*c*-3*f*). As the ball holder rods 61 and the ball holder quadrants 62 are lifted via the trigger activation mechanism 28 an inner surface of each ball holder quadrant 62 contacts an annular tube cam 86 (also see FIG. 5*a*-5*b*) that is located around a bottom edge of the tube body 82. This causes the flexible metal ball holder quadrants 62 to bend outward and away from the golf ball 200, again see FIGS. 3*b* through 3*e*.

Figure 4A:
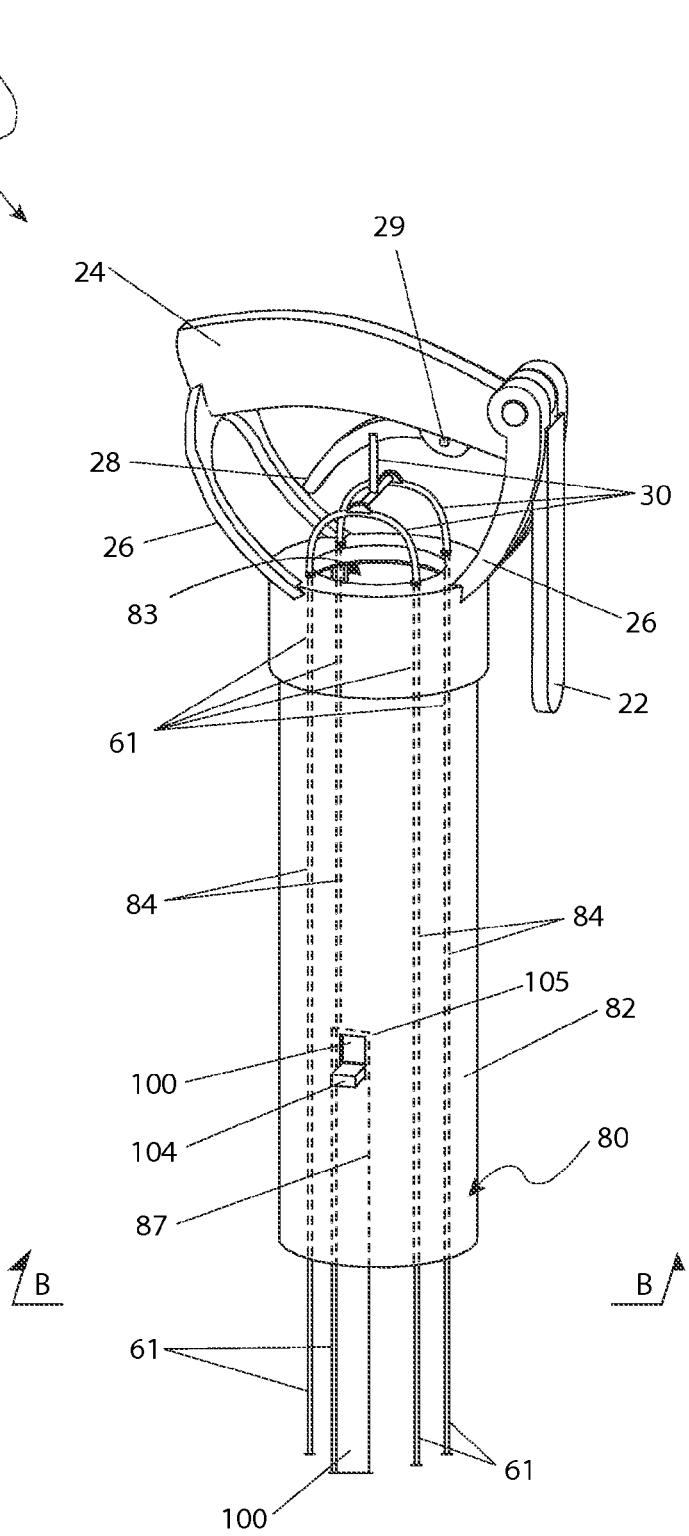
FIG. 4*a* is a perspective view of a handle assembly 20 of the golf placement apparatus 10 shown in FIG. 1.
Figure 4B:
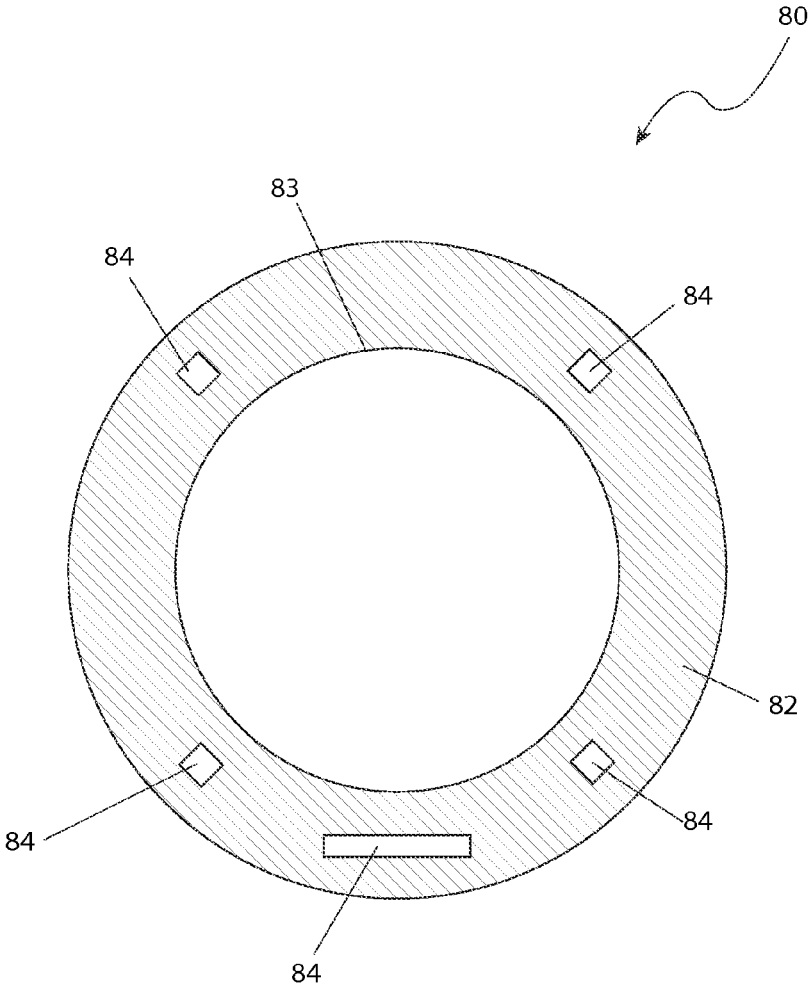
FIG. 4*b* is a section view taken along section line B-B of FIG. 4*a* showing a tube body 82 of the golf placement apparatus 10.

Referring now primarily to FIGS. 4*a* and 4*b*, the handle assembly 20 is permanently affixed to the top of the tube assembly 80. This enables the golfer 215 to both carry and stow the golf placement apparatus 10 and to load and release golf tees 205 and golf balls 200 into the ground 210. The handle assembly 20 includes the golf ball aperture 83, the hook feature 22, a hand grip 24, the trigger release mechanism 28, and an associated ball release linkage 30. The golf ball aperture 83 has a circular cross-section and as previously noted enables top-loading of the golf tee 205 and golf ball 200 into the tube assembly 80 (reference FIGS. 3*a* and 3*b*).

The hand grip 24 has an ergonomic arcuate design and is attached to an upper edge of the tube assembly 80 by a pair of integrally-molded grip brackets 26. The trigger release mechanism 28 pivots on a trigger pivot pin 29. The trigger release mechanism 28 includes a "trigger-shaped" appendage that is in mechanical communication with the ball holder assembly 60. That appendage includes a unitary structure comprised of the ball release linkage 30 and four (4) downwardly extending ball holder rods 61.

Figure 6A:
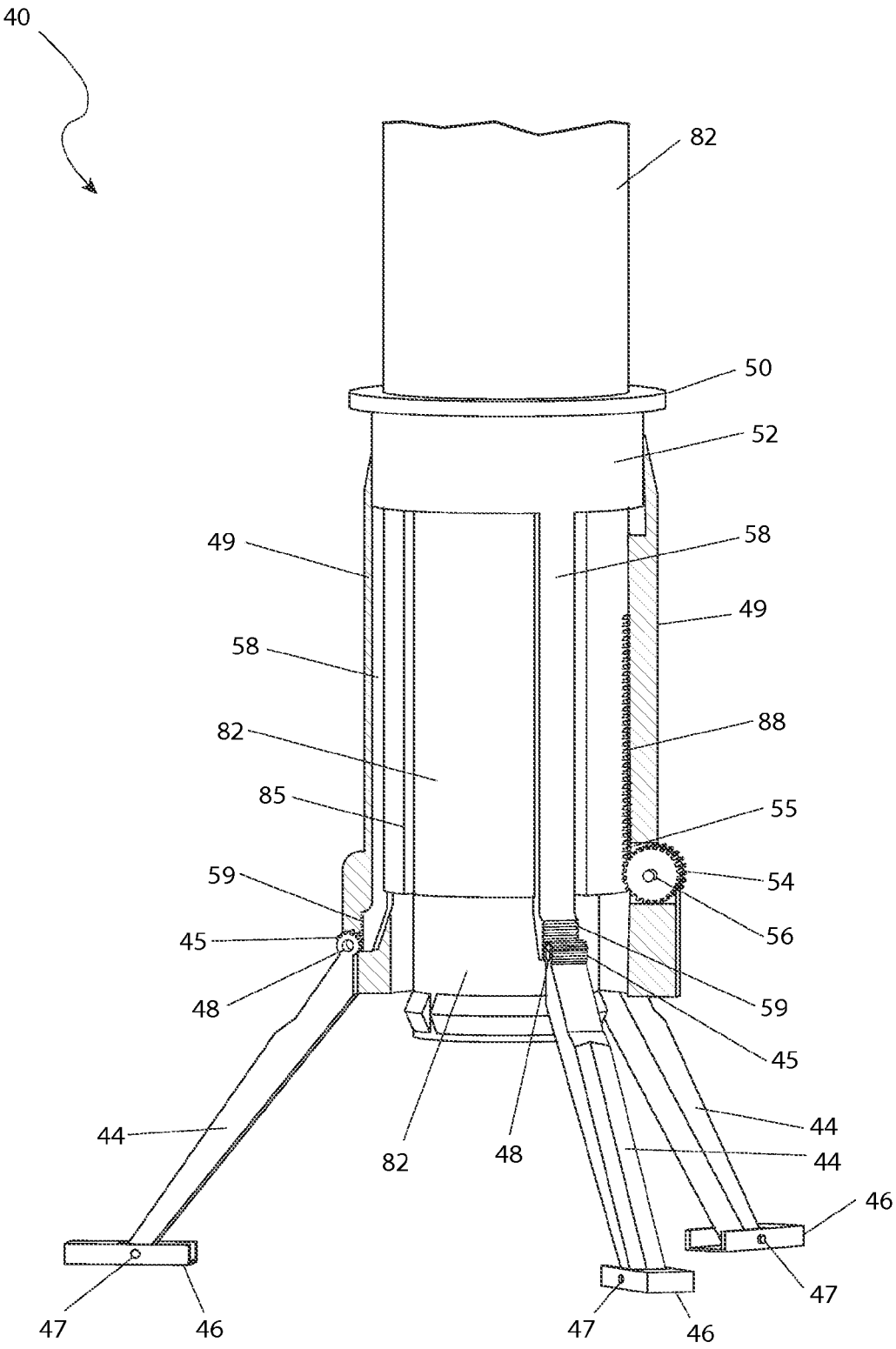
FIG. 6*a* is a cut-away view of the golf ball teeing assembly 40 shown in FIGS. 3*a* and 3*b*, but with deployed legs 44.

The ball release linkage 30 provides a mechanical connection between the trigger release mechanism 28 and the ball holder rods 61. Each ball holder rod 61 is formed from an element that is bent into an inverted "U"-shape. Connecting the inverted "U"-shaped elements to the trigger release mechanism 28 using the ball release linkage 30 allows the golfer 215 to simultaneously raise all four (4) ball holder rods 61 at once by squeezing the trigger release mechanism 28. The ball holder rods 61 extend downward through holder rod apertures 84 (also reference FIG. 4*b*) that are formed within the tube body 82. Referring now primarily to FIGS. 6*a*-7, the bottoms of the ball holder rods 61 are positioned within vertical holder rod slots 85 that are located on a lower outer surface of the tube body 82.

The golf placement apparatus 10 is configured to prevent the golf ball 200 from rising upward within the tube body 82 during insertion of the golf tee 205 into the ground 210. This is accomplished using a ball keeper trigger 104 as shown in FIGS. 1-2, and 4*a*. The ball keeper trigger 104 is located slightly below the handle assembly 20 and along the upper side of the tube assembly 80. This makes the ball keeper trigger 104 easily accessible to the golfer 215. Referring now to FIG. 4, the ball keeper trigger 104 protrudes outward from a rectangular trigger aperture 105 in the tube body 82. The ball keeper trigger 104 includes an integral internal trigger rod 100 which extends downward through a keeper rod aperture 87 formed within the wall of the tube body 82 to the ball keeper rod 90 (see FIGS. 5*a* and 5*b*).

Prior to inserting the golf tee 205 into the ground 210 the golfer 215 presses downward on the ball keeper trigger 104. This causes mechanical retention of the golf ball 200 within the ball holder assembly 60.

Figure 5B:
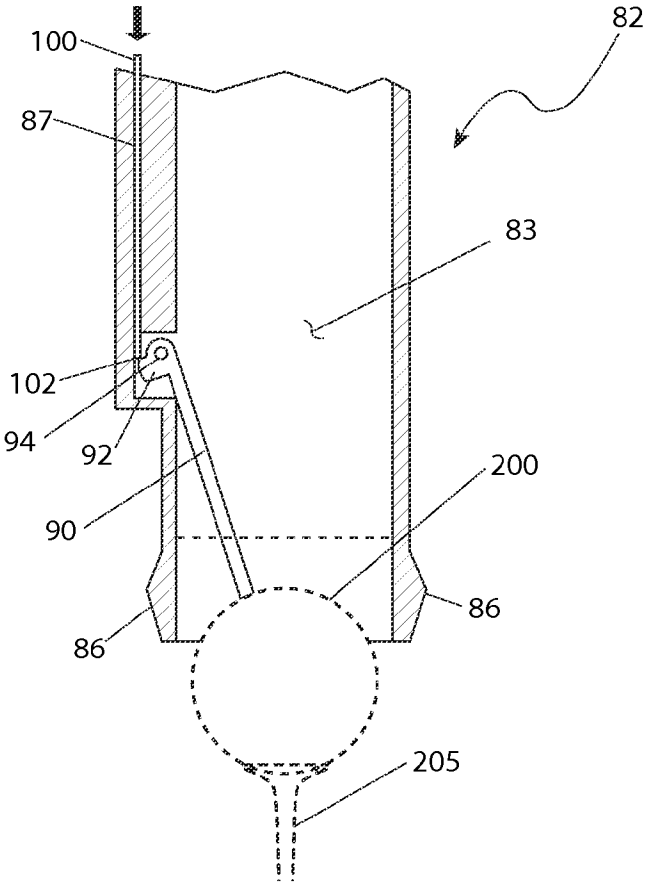
FIG. 5*b* is an isolated section view taken along section line A-A of FIG. 3*a* showing the ball keeper rod 90 in an extended state.
Figure 5A:
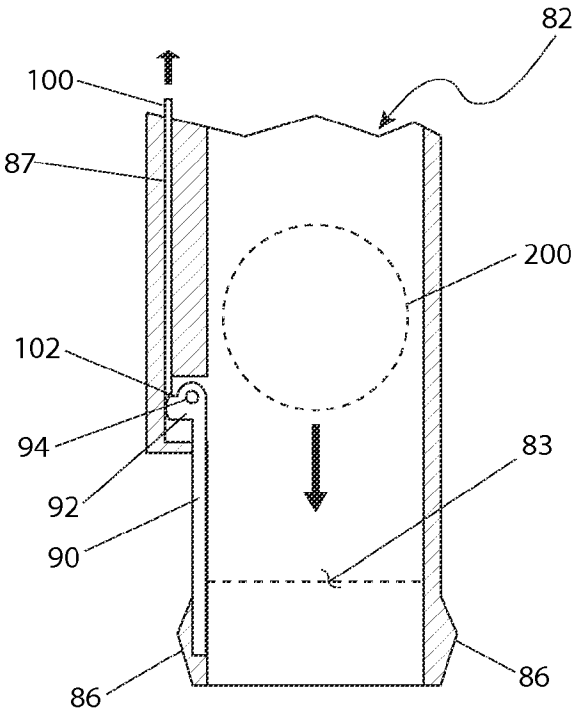
FIG. 5*a* is an isolated section view taken along section line A-A of FIG. 3*a* showing a ball keeper rod 90 in a retracted state.

Still referring to FIGS. 5*a* and 5*b*, the golf ball 200 is selectively retained within the ball holder assembly 60 via the ball keeper rod 90. As previously noted the ball keeper rod 90 is activated when the golfer 215 presses the ball keeper trigger 104 down. To that end the ball keeper rod 90 includes an integral rod pivot 92 on its upper most section which is in contact with a keeper rod slot 102 of the trigger rod 100. When the trigger rod 100 is pushed down the rod pivot 92 pivots on a stationary rod pin 94 that is attached to the tube body 82. This causes the lower end of the ball keeper rod 90 to move toward the center of the tube body 82 and slightly above the golf ball 200. The resulting location of the ball keeper rod 90 prevents upward movement of the golf ball 200 during insertion of the golf tee 205 into the ground 210.

Figure 6B:
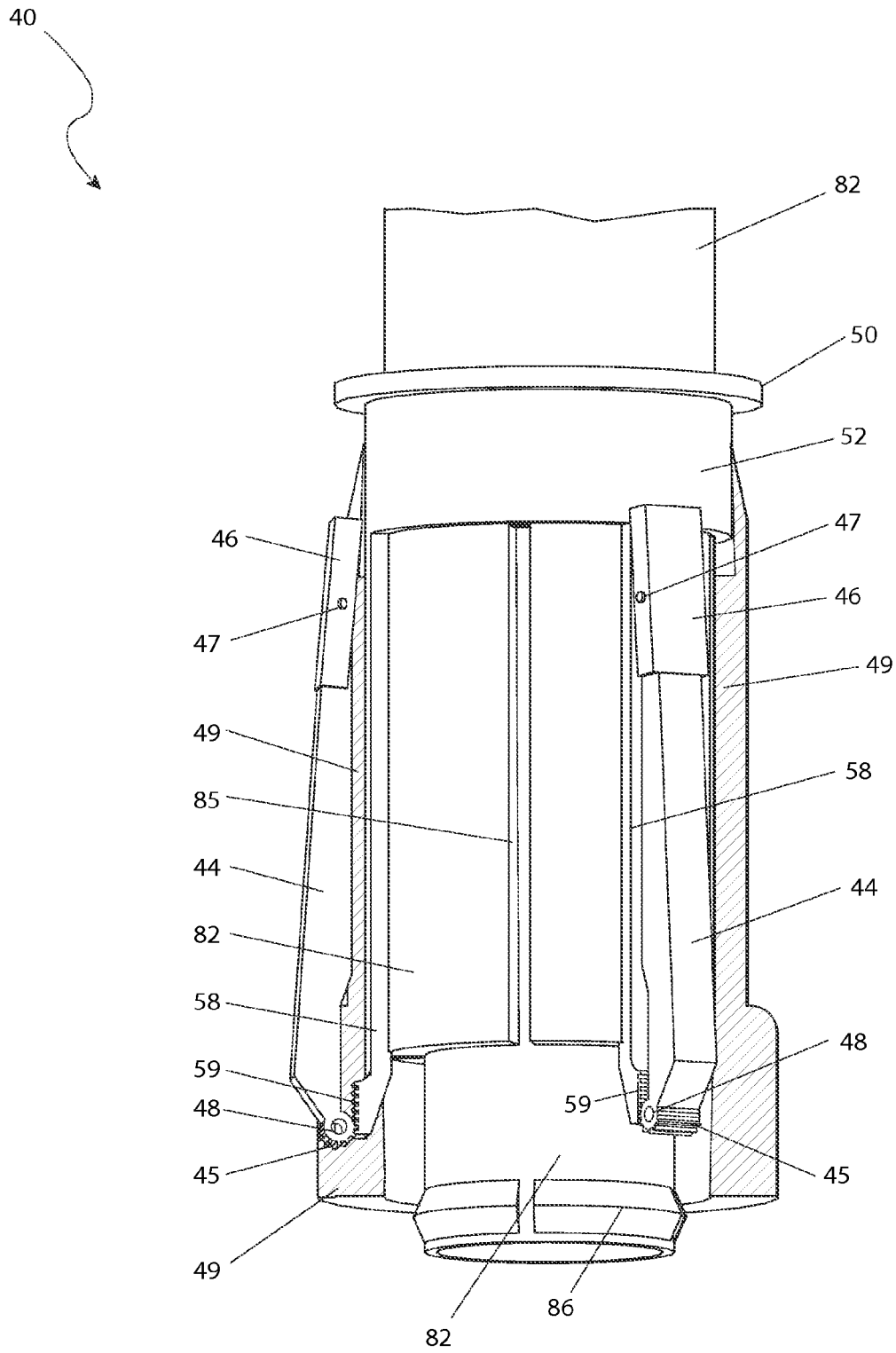
FIG. 6*b* is another cut-away view of the golf ball teeing assembly 40 shown in FIGS. 3*a* and 3*b*, but with retracted legs 44.
Figure 7:
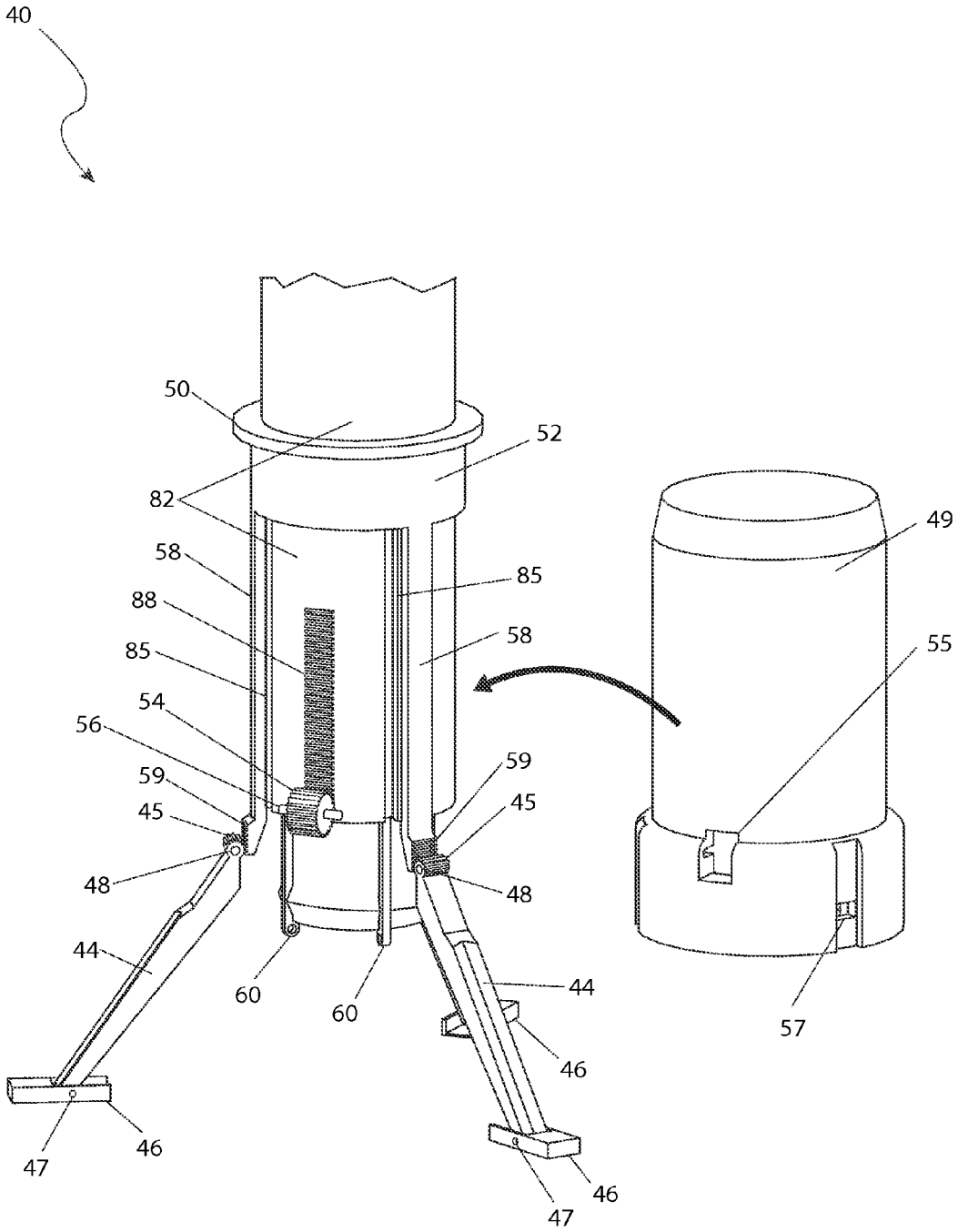
FIG. 7 is an isolated view of depth adjustment elements of the golf ball teeing assembly 40 shown in FIGS. 3*a* and 3*b;*

FIGS. 6*a* and 6*b* present cut-away views of the golf ball teeing assembly 40, respectively depicting deployed and stowed legs 44, while FIG. 7 shows a partially exploded view of the golf ball teeing assembly 40. The retractable legs 44 are set using the leg actuator ring 50, which includes the actuator sleeve 52 and three (3) equally-spaced downward extending actuator posts 58. The body of the actuator sleeve 52 is a hollow, cylinder-shaped member that slides along the lower tube body 82, while the leg actuator ring 50 is a horizontally extending annular ring.

Each actuator post 58 is aligned and engaged with a respective leg 44. Each actuator post 58 includes a vertically-orientated actuator rack gear 59 that is located upon its end. The actuator rack gears 59 mechanically engage with corresponding leg pinion gears 45 that are located at the upper ends of the legs 44. The legs 44 are attached to the depth adjustment housing 49 via the leg pinion gears 45 and within respective leg slots 57 (see FIG. 7) of the depth adjustment housing 49 by leg pinion axles 48.

The vertical position of the depth adjustment housing 49 can be adjusted by rotating the depth adjustment pinion gears 54. The depth adjustment pinion gear 54 is a round gear that rotates on an adjustment pinion axle 56. The depth adjustment pinion gear 54 extends from a pinion aperture 55 through the depth adjustment housing 49 (this is shown in FIG. 7). The depth adjustment pinion gear 54 engages a depth adjustment rack gear 88 that vertically extends along the tube body 82. The depth adjustment rack gear 88 is preferably integrally-molded as part of the tube body 82.

FIG. 7 presents an isolated view of the depth adjustment features of the golf ball teeing assembly 40 with the depth adjustment housing 49 removed. The golf placement apparatus 10 enables vertically positioning of the legs 44 and corresponding feet 46 with respect to the tube body 82. This results in selective insertion of the golf tees 205 into the ground 210 at a desired depth. The feet 46 are envisioned as being affixed to respective legs 44 in a pivoting manner via respective foot pins 47. This enables conforming to an uneven ground 210.

Figure 8A:
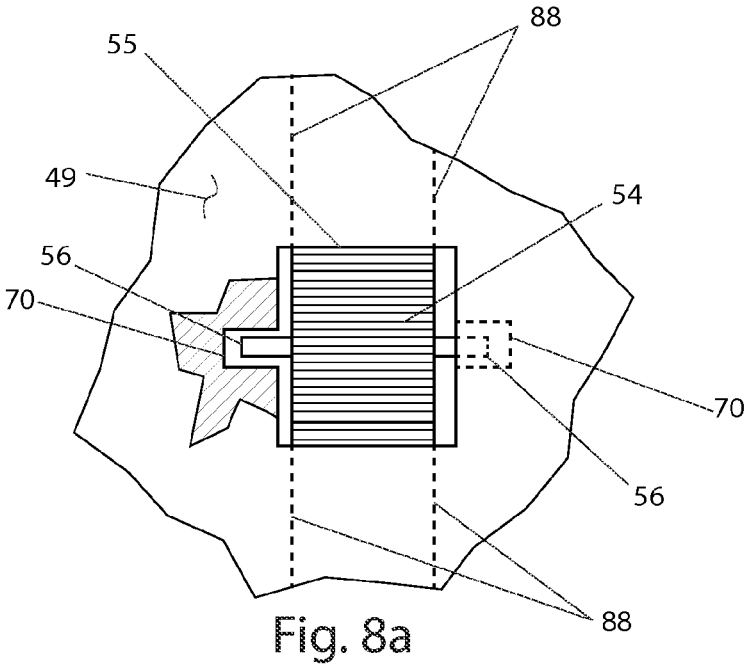
FIG. 8*a* is a close-up cut-away view of a depth adjustment housing 49 depicting a depth adjustment pinion gear 54; and, FIG. 8*b* is another close-up cut-away view of the depth adjustment housing 49 depicting the leg pinion gear 45.

Refer now to FIG. 8*a*, a close-up cut-away view of the depth adjustment housing 49 and a depth adjustment pinion gear 54. The vertical position of the depth adjustment housing 49 is adjusted when a golfer 205 manually rotates the depth adjustment pinion gear 54 along the depth adjustment rack gear 88. The depth adjustment pinion gear 54 rotates within the pinion aperture 55 and on the adjustment pinion axle 56. The adjustment pinion axle 56 is inserted into opposing adjustment pinion axle sockets 70 that are molded into the sides of the pinion aperture 55.

Figure 8B:
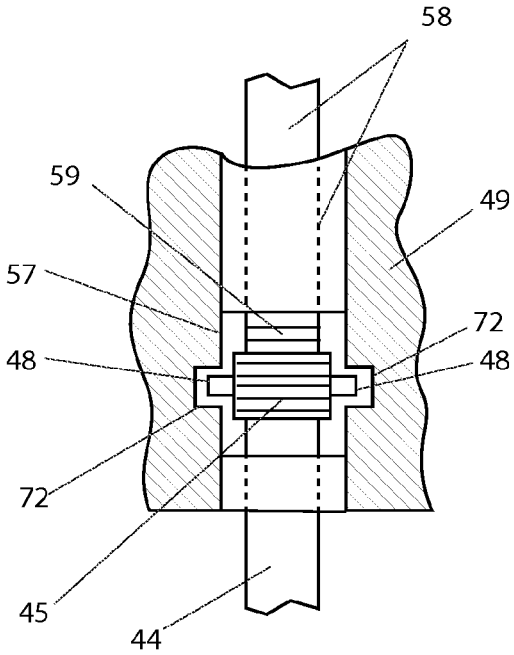

Refer now to FIG. 8*b*, another close-up, cut-away view of the depth adjustment housing 49 but depicting a leg pinion gear 45. The legs 44 rotate relative to the depth adjustment housing 49 via the leg pinion gear 45. Each leg pinion gear 45 is positioned within a respective leg slot 57 and via a leg pinion axle 48. The leg pinion axles 48 are inserted into opposing leg pinion axle sockets 72 that are molded into the sides of the leg slot 57.

It is envisioned that other styles and configurations of the present invention can be easily incorporated into the teachings of the present invention. While only one particular configuration was be shown and described, that is for purposes of clarity and disclosure and not by way of limitation of scope.

The preferred embodiment of the present invention can be utilized by a common golfer 215 in a simple and effortless manner with little or no training. After initial purchase or acquisition of the golf placement apparatus 10, it would be installed as generally indicated in FIGS. 1 and 2.

The method of utilizing the apparatus 10 to insert a golf ball 200 upon a tee 205 into a ground surface 210 may be achieved by performing the following steps: procuring the golf placement apparatus 10; lifting the golf placement apparatus 10 up to approximately waist high and manually pressing the leg actuator ring 50 downward to pivot the legs 44 upward; transporting the golf placement apparatus 10 to a teeing location, preferably by carrying the golf placement apparatus 10 within a golf bag 220 or affixing it externally to a golf bag 220 using the hook 22; arriving at a teeing location; deploying the legs 44 by lifting the golf placement apparatus 10 approximately waist high and manually pulling upward on the leg actuator ring 50; grasping the grip 24 and positioning the golf ball teeing assembly 40 just above the ground 210; inserting a golf tee 205 into the golf ball aperture 83; allowing the golf tee 205 to descend into the tube body 82 such that the pointed end of the tee 205 protrudes downward from the ball holder opening 66; inserting a golf ball 200 into the golf ball aperture 83 and allowing the golf ball 200 to descend into the tube body 82 such that the golf ball 200 rests upon the golf tee 205; pushing down on the ball keeper trigger 104 to secure the golf tee 205 and golf ball 200 in the golf ball teeing assembly 40; lowering the golf placement apparatus 10 to a desired teeing location; pushing downward on the golf placement apparatus 10 to insert the tee 205 into the ground 210 until the feet 46 contact the ground 210; depressing the trigger release mechanism 28; lifting the golf placement apparatus 10 upward, thereby leaving the golf tee 205 and the golf ball 200 inserted into the ground 210; releasing the trigger release mechanism 28; pushing up on the ball keeper trigger 104; driving the golf ball 200 in a conventional manner; repeating the above steps until completing a round of golf; stowing the golf placement apparatus 10 by retracting the legs 44 as previously described; stowing the golf placement apparatus 10 within a golf bag 220 or other appropriate location; and, benefiting from a means to tee up a golf ball 200 while maintaining a standing position afforded a golfer 215.

The method of adjusting the inserted depth of the golf tee 205 during play may be achieved by performing the following: raising or lowering the depth adjustment housing 49 by rotating the depth adjustment pinion gear 54 until positioning the legs 44 at a particular height such that the golf tee 205 and golf ball 200 are inserted into the ground 210 in a desired manner; and, teeing up and driving the golf ball 200 as previously described.

The method of using the golf placement apparatus 10 to retrieve and collect a golf ball 200 and a golf tee 205 may be achieved by: depressing the trigger release mechanism 28 to open the quadrants 62 of the ball holder assembly 60; lowering the ball holder assembly 60 over a golf ball 200 and/or a golf tee 205; releasing the trigger release mechanism 28 to close the ball holder assembly 60 around the golf ball 200 and/or golf tee 205; relocating and releasing the golf ball 200 and/or golf tee 205 using the trigger release mechanism 28 at a desired location; and, repeating the above steps to pick up additional golf balls 200 and tees 205.

The method of utilizing the apparatus 10 to position a golf ball 200 upon a tee 205 previously inserted into the ground surface 210 by performing the following steps: inserting at least one (1) golf ball 200 into the golf ball aperture 83 and allowing said golf ball 200 to descend into the tube body portion 82 such that the golf ball 200 rests within the ball holder assembly 60; pushing down on the ball keeper trigger 104 to secure the golf ball 200 in the ball holder assembly 60; lowering the apparatus 10 onto the pre-positioned tee 205; releasing the trigger release mechanism 28; lifting the apparatus 10 upwardly leaving the golf ball 200 positioned upon the tee 205; depressing the trigger release mechanism 28; pushing up on the ball keeper trigger 104 to release another ball 200 into the ball holder assembly 60; and, repeating the above steps as desired.

The method of utilizing the apparatus 10 to retrieve or relocate a tee 205 and then mount a golf ball 200 for driving may be achieved by performing the following steps: depressing the trigger release mechanism 28 to open the quadrant portions 62 of the ball holder assembly 60; lowering the ball holder assembly 60 over a tee 205 previously inserted into the ground surface 210; releasing the trigger release mechanism 28 to close the ball holder assembly 60 around the tee 205; lifting the apparatus 10 upwardly to extract the tee 205 from the ground surface 210; inserting at least one (1) golf ball 200 into the golf ball aperture 83 and allowing said golf ball 200 to descend into the tube body portion 82 and onto the tee 205; pushing down on the ball keeper trigger 104 to secure the golf ball 200 and tee 205 within the ball holder assembly 60; lowering the apparatus 10 as previously described to insert the tee 205 into the ground surface 210 at a desired location; releasing the trigger release mechanism 28; and, lifting the apparatus 10 upwardly leaving the golf ball 200 and tee 205 positioned for driving.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A golf placement apparatus, comprising:

a tube assembly having a body;

a handle assembly for passing received golf balls and tees to said tube assembly, said handle assembly having a trigger release mechanism; and, a golf ball teeing assembly for receiving golf balls and tees from said tube assembly, for placing a golf ball on a tee, for inserting an end of said tee into the ground, and for releasing the golf ball and tee in response to activation of said trigger release mechanism, comprising:

a plurality of adjustable deployable legs that limit how far a tee is insertable into the ground; and, a depth adjustment for controlling the adjustment of said plurality of adjustable deployable legs, including a pinion gear, a housing over said tube assembly body and operatively connected to said pinion gear such that the position of said housing on said tube assembly body depends on rotation of said pinion gear, and a leg actuator ring in contact with at least one leg of said plurality of adjustable deployable legs.

2. The golf placement apparatus according to claim 1, further including a hook attached to said handle assembly, wherein said hook is configured to enable attachment of the golf placement apparatus to an external receiver.

3. The golf placement apparatus according to claim 1, wherein rotation of said pinion gear in one direction moves said housing down said tube assembly body such that said leg actuator may be motioned to deploy said at least one leg onto a ground surface.

4. The golf placement apparatus according to claim 3, wherein full downward adjustment of said leg actuator forces said at least one leg into a collapsed and stowed position against a depth adjustment housing.

5. The golf placement apparatus according to claim 1, wherein said golf ball teeing assembly further includes a ball holder assembly for receiving said tee and golf ball and for holding said tee and golf ball in position as said tee is inserted into the ground.

6. The golf placement apparatus according to claim 5, wherein said ball holder assembly includes a ball holder opening which enables the tee to protrude out as the golf ball rests on the tee.

7. The golf placement apparatus according to claim 6, wherein said golf ball teeing assembly includes a ball keeper rod for selectively preventing a golf ball on a tee from moving upward as the tee is inserted into the ground.

8. The golf placement apparatus according to claim 7, wherein said ball holder assembly includes a multiple piece ball holder supported by ball holder rods, and wherein said ball holder forms a cup for holding a golf ball.

9. The golf placement apparatus according to claim 8, wherein said ball holder rods operative connect to said trigger release mechanism, and wherein operation of said trigger release mechanism causes said ball holder rods to spread open said ball holder to release the golf ball.

10. The golf placement apparatus according to claim 9, wherein said ball holder rods are lifted via said trigger release mechanism to cause said ball holder to contact an annular member that forces said ball holder away from the golf ball.

11. The golf placement apparatus according to claim 10, wherein said ball holder rods are formed from an inverted "U"-shaped element mechanical connected to said trigger release mechanism by a ball release linkage, and wherein said ball release linkage simultaneously raises said ball holder rods when said trigger release mechanism is squeezed.

12. The golf placement apparatus according to claim 11, wherein said ball holder rods pass through holder rod slots through said tube assembly body.

13. The golf placement apparatus according to claim 12, further includes a rod pin for moving said ball keeper rod away from a golf ball, wherein said rod pin is moved by a ball keeper trigger that passes through said tube assembly.

14. The golf placement apparatus according to claim 1, wherein said handle assembly is permanently affixed to said tube assembly.

15. The golf placement apparatus according to claim 14, wherein said handle assembly includes a hand grip.

16. The golf placement apparatus according to claim 15, wherein said handle assembly has a circular cross-section.

17. The golf placement apparatus according to claim 1, wherein each leg of said plurality of adjustable deployable legs includes a pivoting foot.

* * * * *